US005863494A

United States Patent [19]

Nazmy et al.

[11] Patent Number: 5,863,494

[45] **Date of Patent: *Jan. 26, 1999**

[54] IRON-NICKEL SUPERALLOY OF THE TYPE IN 706

[75] Inventors: Mohamed Nazmy, Fislisbach; Corrado Noseda, Remetschwil, both of Switzerland; Joachim Rösler, Braunschweig, Germany; Markus Staubli, Dottikon, Switzerland

[73] Assignee: Asea Brown Boveri AG, Baden, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 707,610

[22] Filed: Sep. 5, 1996

[30] Foreign Application Priority Data

Nov. 17, 1995 [DE] Germany ..... 195 42 920.6

[51] Int. Cl.[6] ..... C22C 30/00

[52] U.S. Cl. ..... 420/584.1; 420/386.1; 148/442; 148/419; 416/223 R; 416/241 R

[58] Field of Search ..... 420/584.1, 586.1; 416/223 R, 241 R; 148/419, 442

[56] References Cited

U.S. PATENT DOCUMENTS

| | | | |
|---|---|---|---|
| 3,705,827 | 12/1972 | Muzyka et al. . | |
| 3,785,876 | 1/1974 | Bailey | 420/586 |
| 5,415,712 | 5/1995 | Thamboo | 148/707 |

FOREIGN PATENT DOCUMENTS

| | | |
|---|---|---|
| 1082739 | 6/1960 | Germany . |
| 2223114 | 11/1972 | Germany . |
| 2348248 | 4/1974 | Germany . |

OTHER PUBLICATIONS

"The Microstructure of 706, a new Fe–Ni–Base Superalloy", Moll, et al., Metallurgical Transactions, vol. 2, Aug. 1971, pp. 2143–2151.

"Environmental Damage of a Cast Nickel Base Superalloy", Woodford, Metallurgical Transactions, vol. 12A, Feb. 1981, pp. 299–308.

"Heat Treatment of 706 Alloy for Optimum 1200°F Stress–Rupture Properties", Moll, et al., Metallurgical Transactions, vol. 2, Aug. 1971, pp. 2153–2160.

CA 76: 62338 1971.

*Primary Examiner*—Margery Phipps

*Attorney, Agent, or Firm*—Burns, Doane, Swecker & Mathis, L.L.P.

[57] ABSTRACT

An iron-nickel superalloy of the type IN 706 has an addition of 0.02 to 0.3 percent by weight of boron and/or 0.05 to 1.5 percent by weight of hafnium. By means of this addition, a virtual doubling of the ductility is achieved as compared with an addition-free iron-nickel superalloy of the type IN 706, while the hot strength is reduced only slightly. The alloy is particularly suitable as a material for rotors of large gas turbines. It has a sufficiently high hot strength. When locally acting temperature gradients arise unwanted stresses can occur to only a slight extent because of the high ductility of the alloy.

10 Claims, No Drawings

IRON-NICKEL SUPERALLOY OF THE TYPE IN 706

BACKGROUND OF THE INVENTION

Field of the Invention

The invention starts from an iron-nickel superalloy of the type IN 706. The invention also relates to a process for the production of a body of material stable at high temperatures from a starting body formed from this alloy.

Iron-nickel superalloys of the type IN 706 are distinguished by high strength at temperatures of around 700° C. and are therefore used with advantage in heat engines such as, in particular, gas turbines. The composition of the alloy IN 706 can fluctuate within the limiting ranges given below:

max. 0.02 carbon
max. 0.10 silicon
max. 0.20 manganese
max. 0.002 sulfur
max. 0.015 phosphorus
15 to 18 chromium
40 to 43 nickel
0.1 to 0.3 aluminum
max. 0.30 cobalt
1.5 to 1.8 titanium
max. 0.30 copper
2.8 to 3.2 niobium
remainder iron.

DISCUSSION OF BACKGROUND

Iron nickel superalloys of the type IN 706 are described, for instance, in publications by J. H. Moll et al. entitled "The Microstructure of 706, a New Fe—Ni-Base Superalloy" Met. Trans. 1971, Vol.2, pp.2143–2151, and "Heat Treatment of 706 Alloy for Optimum 1200° F. Stress-Rupture Properties" Met. Trans. 1971, Vol.2, pp.2153–2160.

In this prior art, attention is drawn to the fact that the ductility of the alloy IN 706 is relatively low at temperatures around 650° C. and that it is possible, by certain heat treatment processes, to increase the ductility of forgings made from the alloy IN 706. Depending on the microstructure of a starting body forged from the alloy IN 706, typical heat treatment processes comprise the following process steps:

solution annealing of the starting body at a temperature of 980° C. for a period of 1 h,
cooling of the solution-annealed starting body with air,
precipitation hardening at a temperature of 840 for a period of 3 h,
cooling with air,
precipitation hardening at a temperature of 720° C. for a period of 8 h,
cooling at a cooling rate of about 55° C./h to 620° C., precipitation hardening at a temperature of 620° C. for a period of 8 h and cooling with air or solution annealing of the starting body at temperatures around 900° C. for 1 h,
cooling with air,
precipitation hardening at 720° C. for a period of 8 h,
cooling at a cooling rate of about 55° C./h to 620° C., precipitation hardening at 620° C. for 8 h and cooling with air.

It is furthermore known, from the essay by D. A. Woodford entitled "Environmental Damage of a Cast Nickel Base Superalloy" Met.Trans.A, Feb. 1981, Vol. 12A, pp.299–307, that additions of boron and hafnium to the nickel base superalloy of the type IN 738 reduce susceptibility to damage caused by oxygen access. These additions reduce unwanted embrittlement of the material.

SUMMARY OF THE INVENTION

Accordingly, one object of the invention is to provide an iron-nickel superalloy of the type IN 706 which, while having a high hot strength, is distinguished by great ductility, and, at the same time, to specify a process by means of which the ductility of a body of material formed from this alloy can be additionally improved.

The alloy according to the invention is distinguished, in particular, by the fact that it has virtually twice as great a long-term ductility and only a slightly reduced hot strength in comparison with an iron-nickel superalloy of the type IN 706 which is free from B and/or Hf additions. Additions of boron and/or hafnium in appropriate quantities reduce the oxidation of the grain boundaries of the microstructure of the alloy which is promoted by stress forces. Unwanted material fatigue phenomena, such as notch embrittlement and the growth of stress cracks are thus quite considerably reduced. This alloy is therefore particularly suitable as a material for rotors of large gas turbines. The alloy has a sufficiently high hot strength. When locally acting temperature gradients occur, unwanted stress forces have only a slight effect in the microstructure because of the high ductility of the alloy. The ductility of the alloy according to the invention can be improved even further by suitable heat treatment steps, comprising solution annealing, cooling and precipitation hardening.

A more complete appreciation of the invention and many of the attendant advantages thereof will be readily obtained as the same becomes better understood by reference to the following detailed description.

DESCRIPTION OF THE PREFERRED EMBODIMENTS

Three iron-nickel superalloys A, B and C of the type IN 706 were melted in a vacuum furnace. The compositions of these alloys are summarized in table form below:

| Alloy | A | B | C |
|---|---|---|---|
| Carbon | 0.01 | 0.01 | 0.01 |
| Silicon | 0.04 | 0.04 | 0.04 |
| Manganese | 0.12 | 0.12 | 0.12 |
| Sulfur | <0.001 | <0.001 | <0.001 |
| Phosphorus | 0.005 | 0.005 | 0.005 |
| Chromium | 16.03 | 16.03 | 16.03 |
| Nickel | 41.9 | 41.9 | 41.9 |
| Aluminum | 0.19 | 0.19 | 0.19 |
| Cobalt | 0.01 | 0.01 | 0.01 |
| Titanium | 1.67 | 1.67 | 1.67 |
| Copper | <0.01 | <0.01 | <0.01 |
| Niobium | 2.95 | 2.95 | 2.95 |
| Boron | — | 0.2 | — |
| Hafnium | — | — | 1.0 |
| Iron | remainder | remainder | remainder |

These alloys were solution-annealed for 1 h at a temperature of 980° C., then cooled with air to room temperature and then subjected to precipitation hardening consisting in a 10-hour heat treatment at 730° C., followed by cooling in the furnace to 620° C. and a subsequent 16-hour heat treatment at 620° C. The bodies of material A', B', C' formed during this process were cooled with air to room temperature. Rotationally symmetrical test pieces for tensile tests were turned from the bodies of material. These test pieces were provided at each of their ends with a thread that could be inserted into a test machine and they each had a section 5 mm in diameter and with a length of about 24.48 mm in the form of a round bar extending between two measuring marks. At a temperature of 705° C., the test pieces were stretched at strain rates of $7{\cdot}09{\cdot}10^{-5}s^{-1}$, and $7{\cdot}09{\cdot}10^{-7}s^{-1}$ until they broke. The values determined in this process for tensile strength and elongation at break are summarized below in the form of a table

| Body of material | Strain rate $7.09 \cdot 10^{-5}$ | $[s^{-1}]$ $7.09 \cdot 10^{-7}$ | Tensile strength [MPa] at 705° C. | Elongation at break [%] at 705° C. |
|---|---|---|---|---|
| A' | x | | 705 | 16.4 |
| A' | | x | 597 | 6.7 |
| B' | x | | 765 | 13.6 |
| B' | x | | 752 | 11.1 |
| B' | | x | 541 | 12.0 |
| C' | x | | 708 | 14.4 |
| C' | | x | 570 | 10.6 |

From the values determined, it can be seen that, at a temperature of 705° C. and with slow stretching, the figures for elongation at break in the case of bodies of material B' and C' formed from the alloys according to the invention are about 50 to 80% higher than the elongation at break in the case of body of material A' formed from the alloy in accordance with the prior art.

In corresponding fashion, the figures for tensile strength at a temperature of 705° C. and at a fast strain rate of material B' and C' formed from the alloys according to the invention are at least as good as the tensile strength in the case of the body of material A' formed from the alloy according to the prior art.

At the slow strain rate, the material has sufficient time to relax. The strength figures which are determined at this rate are therefore not as informative as those determined at the faster strain rate. At the slow strain rate, by contrast, the oxygen contained in the environment has sufficient time to cause embrittling grain boundary effects. The figures for elongation at break determined at the slow strain rate are therefore more informative than those determined at the fast strain rate. At 705° C., the bodies of material B' and C' formed from the alloys according to the invention therefore surpass by far in ductility the body of material A' produced from the alloy of the prior art and are at least equal to it as regards their hot strength. Bodies of material formed from the alloys according to the invention can be used with great advantage as rotors of large gas turbines since they have a sufficiently high hot strength and since, because of the high ductility of the material, unavoidable local temperature gradients can build up only small stresses locally.

The abovementioned properties are achieved with the alloys according to the invention if the boron content is from 0.02 to 0.3 percent by weight and that of hafnium is from 0.05 to 1.5 percent by weight. If the boron or hafnium content is lower, the grain boundaries of the alloys are no longer affected and embrittlement occurs. If the boron or hafnium content is too high, the suitability of the alloys for hot working is impaired.

Bodies of material which are sufficiently good for many applications can be achieved if they are solution-annealed at temperatures of between 900° C. and 1000° C. and then precipitation-hardened in a first stage at temperatures of between 700° C. and 760° C. and, in a second stage, at temperatures of between 600° C. and 650° C.

The ductility of the alloy according to the invention can be improved further to a considerable extent by suitable cooling. A preferred cooling rate at which the material is brought from the annealing temperature envisaged for solution annealing to the temperature envisaged for precipitation hardening is from between 0.5° and 20° C./min.

It is recommended that the transition from the first to the second stage of precipitation hardening should also be carried out by cooling in the furnace.

The solution annealing should be carried out for a period of at most 15 h at temperatures of between 900° and 1000° C., depending on the size of the starting body.

The precipitation hardening effected by holding at certain temperatures should preferably be carried out for a period of at least 10 h and at most 70 h. In the process of precipitation hardening, the solution-annealed starting body should be held at the temperature for a period of at least 10 h and at most 50 h in the first stage and for a period of at least 5 h and at most 20 h in the second stage.

Obviously, numerous modifications and variations of the present invention are possible in light of the above teachings. It is therefore to be understood that within the scope of the appended claims, the invention may be practiced otherwise than as specifically described herein.

What is claimed is:

1. An iron-nickel superalloy rotor of a large gas turbine, the superalloy consisting essentially, in weight %, of: ≦0.02% C, ≦0.10% Si, ≦0.20% Mn, ≦0.002% S, ≦0.015% P, 15 to 18% Cr, 40 to 43% Ni, 0.1 to 0.3% Al, ≦0.30% Co, 1.5 to 1.8% Ti, ≦0.30% Cu, 2.8 to 3.2% Nb, 0.02 to 0.3% B and/or 0.05 to 1.5% Hf, balance Fe.

2. The superalloy rotor of claim 1, wherein the B content is 0.02 to 0.3%.

3. The superalloy rotor of claim 1, wherein the Hf content is 0.05 to 1.5%.

4. The superalloy rotor of claim 1, wherein the B content is about 0.2%.

5. The superalloy rotor of claim 1, wherein the Hf content is about 1 %.

6. The superalloy rotor of claim 1, wherein the superalloy comprises a cast and heat treated body having an elongation measured at 705° C. and at a strain rate of $7{\cdot}09{\cdot}10^{-7}s^{-1}$ at least 50% higher than that of an identically heat treated body free of B and Hf.

7. The superalloy rotor of claim 1, wherein the B is present in an amount effective to reduce stress induced oxidation of grain boundaries in a body of the superalloy.

8. The superalloy rotor of claim 1, wherein the Hf is present in an amount effective to reduce stress induced oxidation of grain boundaries in a body of the superalloy.

9. The superalloy rotor of claim 1, wherein the superalloy comprises a solution annealed and precipitation hardened body.

10. The superalloy rotor of claim 1, wherein the superalloy includes 0.02 to 0.3% B and 0.05 to 1.5% Hf.

* * * * *